US006677937B1

(12) United States Patent
Takahashi et al.

(10) Patent No.: US 6,677,937 B1
(45) Date of Patent: Jan. 13, 2004

(54) DRIVING METHOD FOR DISPLAY AND A LIQUID CRYSTAL DISPLAY USING SUCH A METHOD

(75) Inventors: Masahiro Takahashi, Yamatokoriyama (JP); Yoshiyuki Kokuhata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 200 days.

(21) Appl. No.: 09/604,812

(22) Filed: Jun. 28, 2000

(30) Foreign Application Priority Data

Jun. 28, 1999 (JP) ..... 11-182345
Jun. 1, 2000 (JP) ..... 2000-165135

(51) Int. Cl.[7] ..... G09G 5/00

(52) U.S. Cl. ..... 345/212; 345/87; 345/92; 345/98; 345/100; 345/211; 345/214; 345/93; 345/94

(58) Field of Search ..... 345/98, 100, 211, 345/212, 214, 204, 92, 87, 90, 93, 94

(56) References Cited

U.S. PATENT DOCUMENTS 5,248,963 A * 9/1993 Yasui et al. ..... 345/98
5,309,150 A 5/1994 Ohba et al.
5,663,744 A 9/1997 Seike et al.
5,760,758 A 6/1998 Seike et al.
5,793,346 A * 8/1998 Moon ..... 345/92
6,064,360 A * 5/2000 Sakaedani et al. ..... 345/92
6,084,580 A 7/2000 Takahashi et al.
6,151,016 A * 11/2000 Kanbe et al. ..... 345/204
6,271,812 B1 * 8/2001 Osada et al. ..... 345/76

* cited by examiner

*Primary Examiner*—Richard Hjerpe
*Assistant Examiner*—Jennifer T. Nguyen
(74) *Attorney, Agent, or Firm*—Birch, Stewart, Kolasch & Birch, LLP

(57) ABSTRACT

A driving method is disclosed which prevents a remaining image from occurring at the time of turning off of the display device. In particular, the driving method for the display device is such that, when the power-supply signal is switched from ON state to OFF state, non-lit-up display data is outputted so that all the pixels are switched to the non-lit-up display. The display elements are maintained in the non-lit-up display state over the entire surface of the display up to completion of a period corresponding to a predetermined number of frames after the frame in which the power-supply OFF signal has been detected. The driving operation, which takes place immediately before the completion of the output of the non-lit-up display data within the non-display period, is maintained until the scanning start signal has risen, and the driver output control signal is switched from ON state to OFF state in synchronism with the rise of the scanning start signal.

11 Claims, 13 Drawing Sheets

DRIVING METHOD FOR DISPLAY AND A LIQUID CRYSTAL DISPLAY USING SUCH A METHOD

FIELD OF THE INVENTION

The present invention relates to a driving method for an active-matrix-type display using switching elements, and also concerns a liquid crystal display driven by such a driving method.

BACKGROUND OF THE INVENTION

Recently, along with the development of the information-dependent society, mobile information terminals, in particular, personal data asistances (PDA), have received much attention. One of objectives with these personal data assistances is to achieve low power consumption, and liquid crystal displays have been mainly used as the display device thereof.

Liquid crystal displays are mainly classified into two types, that is, the passive-matrix type and the active matrix type, and the latter type has superior features in the display quality. The active-matrix-type displays are classified into two types, that is, those using three-terminal elements such as TFTs (Thin Film Transistors) and those using two-terminal elements such as MIM (Metal-Insulator-Metal) devices, as the switching elements thereof. The latter type is advantageous in that the manufacturing process is simpler as compared with the former, making it possible to achieve low costs, and in that the two-terminal construction makes the electrode wiring simpler and the device smaller, resulting in a higher aperture ratio in pixels.

FIG. 6 shows the construction of a conventional active-matrix-type liquid crystal display 51 using two-terminal elements. The liquid crystal display 51 is provided with a display panel section 60 having a structure in which a liquid crystal layer is sandwiched by a pair of substrates. More specifically, as indicated by an equivalent circuit in FIG. 7, the display panel section 60 has an arrangement in which two-terminal elements 72 and liquid crystal display elements 71 (display elements) are series-connected for each unit area between a plurality of scanning electrodes Yi (i=1, 2, . . . , m) and a plurality of data electrodes Xj (j=1, 2, . . . , n) that are arranged in directions so as to intersect each other, and areas corresponding the respective liquid crystal display elements 71 are arranged in a matrix format as pixels.

A driver 64 for scanning-electrode signals selects the respective scanning electrodes Yi in a line-sequential manner for each frame period and applies a predetermined selection voltage thereto, and is normally constituted by a control section, shift registers, analog switches, etc. A driver 62 for data-electrode signals applies a predetermined data signal voltage corresponding to display data to respective data electrodes Xj that are in the selection period. Thus, the selection voltage and the data signal voltage are applied to the respective pixels during the selection period. A voltage difference between the selection voltage and the data signal voltage allows a charge corresponding to the display data to be accumulated. This charge is maintained by the two-terminal elements 72 until the next selection period so that the display state is maintained during one frame period. In other words, the display state is desirably controlled on the display panel section 60 by applying predetermined voltages to the respective ends of each pixel.

In order to display external input information on the display panel 60, a control section 65 sends control signals to a voltage-forming circuit 61 for forming a voltage to be applied to the driver 62 for data-electrode signals as well as to a voltage-forming circuit 63 for forming a voltage to be applied to the driver 64 for scanning-electrode signals. Input signals to the control section 65 consist of a scanning start signal S, a scanning clock LP, a clock CLK, a display data signal DATA, a data enable signal ENAB, a power-supply signal DISP, etc. Among these, the scanning clock LP, the clock CLK, the display data signal DATA and the data enable signal ENAB are outputted to the voltage-forming circuit 61 and the driver 62 for data-electrode signals, while the scanning start signal S and the scanning clock LP are outputted to the voltage-forming circuit 63 and the driver 64 for scanning-electrode signals.

A power-supply voltage for driving the liquid crystal display 51, not shown, is sent to the voltage-forming circuits 61 and 63. Thus, the power-supply voltage and the respective signals sent from the control section 65 are used to form voltage waveforms to be applied to the data electrode Xj and the scanning electrodes Yi.

FIG. 8 shows one example of a timing chart of the above-mentioned input signal. When a selection voltage, not shown, is applied to the respective scanning electrodes Yi during a selection period corresponding to the frequency of the scanning clock LP, the display data signal DATA (a signal corresponding to the "HIGH" period of the data enable signal ENAB), which has a data signal voltage sent in synchronism with the clock CLK, is outputted to the respective data electrodes Xj so that a voltage corresponding to a difference between the selection voltage and the data signal voltage is applied to the respective pixels. The signal indicating the scanning start of one frame is the scanning start signal S, and the scanning clocks LP the number of which is not less than the number of scanning electrodes are present within one period of the scanning start signal S. These signals are generated and supplied while the power-supply signal DISP goes high, from the application of the power until the liquid crystal display 51 to the cut-off thereof.

The active-matrix type liquid crystal display 51 using two-terminal elements 72 has a problem in which a sticking phenomenon occurs due to variations in the voltage-current characteristics of the two-terminal elements 72. In order to solve this problem, U.S. Pat. No. 5,760,758 (published on Jun. 2, 1998) and U.S. Pat. No. 5,663,744 (published on Sep. 2, 1997) have disclosed a driving method in which, during the selection period of the respective scanning electrodes, a voltage is switched to a plurality of levels and applied to the scanning electrodes. FIGS. 9 and 10 show examples of waveforms to be applied to the display panel in the above-mentioned method.

FIG. 9 shows the construction of U.S. Pat. No. 5,760,758 in which a voltage to be applied to the scanning electrodes for one selection period is switched to two levels. Supposing that the liquid crystal display to which this driving method is applied has the same structure as the liquid crystal display 51 of FIG. 6, signals, sent from the control section 65 and the voltage-forming section 63 to the driver 64 for scanning-electrode signals, allow signals 85 and 86 having voltage waveforms as respectively shown in the Figure to the scanning electrodes Yi and Yi+1, respectively. In the same manner, the signals, sent from the control section 65 and the voltage-forming section 61 to the driver 62 for data-electrode signals, and the display data signal DATA allow a signal 87 having a voltage waveform indicated by a solid line or a broken line in accordance with the display data to be supplied to the data electrodes Xj. Signals 81 to 84 are part of signals generated in the control section 65; and signal 81 is a scanning start signal S for determining the scanning start for one frame, signal 82 is a scanning clock LP for deciding one selection period, signal 83 is a signal for controlling the pulse width with respect to the voltage levels to be applied to the scanning electrodes Yi during one selection period, and signal 84 is a signal for determining the polarity of the respective voltage levels.

FIG. 10 shows the construction of U.S. Pat. No. 5,663,744 in which a voltage to be applied to the scanning electrodes for one selection period is switched to three levels. Similarly, supposing that the same structure as the liquid crystal display 51 of FIG. 6 is used, signals, sent from the control section 65 and the voltage-forming section 63 to the driver 64 for scanning-electrode signals, allow signals 95 and 96 having voltage waveforms as respectively shown in the Figure to the scanning electrodes Yi and Yi+1, respectively. In the same manner, the signals, sent from the control section 65 and the voltage-forming section 61 to the driver 62 for data-electrode signals, and the display data signal DATA allow a signal 97 having a voltage waveform indicated by a solid line or a broken line in accordance with the display data to be supplied to the data electrodes Xj. Signals 91 to 94 are part of signals generated in the control section 65; and signal 91 is a scanning start signal S for determining the scanning start for one frame, signal 92 is a scanning clock LP for deciding one selection period, signal 93 is a signal for controlling the pulse width with respect to the respective voltage levels to be applied to the scanning electrodes Yi during one selection period, and signal 94 is a signal for determining the polarity of the respective voltage levels.

However, in the above-mentioned conventional liquid crystal display 51, upon turning the power switch off, simultaneously as the power-supply signal DISP falls as shown in FIG. 11, all the signal supplies including the selection voltage and the display data signal DATA are stopped at once due to the termination of the driver output control signal DSPOF for determining the presence or absence of the driver output and other control signals. Therefore, with respect to the pixels that have been lit up immediately before turning the power switch off, the electric charge corresponding to the lit-up display is left accumulated for a while even after turning the power switch off due to the charge maintaining effect of the two-terminal elements 72 serving as the charge-maintaining elements installed in the display panel section 60, with the result that the display pattern immediately before turning the power switch off remains, causing a problem of remaining images.

Moreover, in the method as shown in FIG. 9 or FIG. 10 in which one selection period is driven while switching the voltage to several voltage levels, supposing that a voltage at the border between the conducted state (ON state) and the non-conducted state (OFF state) of the two-terminal elements 72 is defined as a threshold voltage, all the two-terminal elements are once switched to the ON state by applying a voltage exceeding the threshold voltage at the start of one selection period so that a charge is accumulated in the liquid crystal; thereafter, in the case of the lit-up display, a voltage for maintaining the accumulated state of the charge is applied at the succeeding stage, and in the case of the non-lit-up display, such a voltage as to draw the charge is applied at the succeeding stage.

With this arrangement, the characteristics of all the two-terminal elements in the display panel section 60 are uniformly maintained so that it is possible to reduce the occurrence of the sticking phenomenon. In this driving method, however, in the case when, for example, switching is made to three voltages, upon turning the power switch off while the selection voltage is being applied to the scanning electrodes Yi, a voltage (a driver output for scanning electrode signals) $V_{COM}$, indicated by a solid line in FIG. 12 and FIG. 13, is applied to the scanning electrodes Yi, with the result that pixels on the scanning electrodes Yi are lit up, causing a residual display image. Moreover, in this case, since a dc voltage is applied to the liquid crystal display elements 71 for a long time, the liquid crystal is adversely affected and subjected to deterioration.

Moreover, in the case of the light-transmitting type liquid crystal display, since the backlight is turned off simultaneously as, or immediately before the display is turned off, this remaining image is not so conspicuous; however, in the case of the reflection type liquid crystal display, since external light is not shielded, this remaining image becomes very conspicuous.

Here, this problem of remaining images also arises in the case when three-terminal elements such as TFTs are used as switching elements.

SUMMARY OF THE INVENTION

The present invention has been devised so as to solve the above-mentioned problems, and its objective is to provide an active-matrix-type display using switching elements which causes no remaining image at the time of turning the power switch off, and a liquid crystal display using such a driving method.

In order to achieve the above-mentioned objective, the driving method for a display device of the present invention, which is applied to a display device that is provided with a plurality of scanning electrodes and a plurality of data electrodes that are arranged in directions so as to intersect each other, display elements having respective pixels which are arranged in a matrix format and have their display state determined by controlling a quantity of charge, and switching elements, installed in the respective pixels, for switching a charging current to the pixels, is arranged so that, with respect to the scanning electrodes, selection is line-sequentially made for each frame period and a selection voltage is applied thereto, and to the data electrodes is applied a data signal voltage corresponding to a display state, so that the pixels are charged. This driving method for a display device is further characterized in that, when a power-supply signal indicating that the power supply of the display device is to be turned off is detected, after all the pixels have been switched to the non-lit-up state, the application of the above-mentioned selection voltage to the scanning electrodes and the application of the above-mentioned data signal voltage to the data electrodes are stopped.

In the above-mentioned invention, at the time when, upon turning off the power supply of the display device, a power-supply signal indicating that the power supply of the display device is to be turned off is detected, corresponding charges have still been accumulated in the pixels; therefore, the accumulated charge of each pixel is discharged so as to set to the quantity of charge corresponding to the non-lit-up display so that all the pixels are switched to the non-lit-up state, that is, so that the display elements are switched to the non-lit-up state on the entire surface. Then, after this state has been achieved, the application of the above-mentioned selection voltage to the scanning electrodes and the application of the above-mentioned data signal voltage to the data electrodes are stopped.

With this arrangement, no pixels in the lit-up state exist in the display elements at the time of completion of the display;

therefore, it becomes possible to prevent the occurrence of residual image resulting from a display image immediately before the turning off, even after the power supply of the display device is turned off.

In order to achieve the above-mentioned objective, the driving method for a display device of the present invention is characterized in that a non-display period in which the selection voltage is not applied to any of the scanning electrodes is formed in one frame period, and in that after all the pixels have been switched to the non-lit-up state after the detection of the power-supply signal, the application of the above-mentioned selection voltage to the scanning electrodes and the application of the above-mentioned data signal voltage to the data electrodes are preferably stopped in synchronized timing with an inter non-display period signal.

In the above-mentioned invention, the non-display period is provided, and after the power-supply signal indicating that the power supply of the display device is to be turned off has been detected, the pixels maintained in the lit-up state are switched to the non-lit-up state, and the display is then turned off in the non-display period. The timing in which the display is turned off may be any time as long as it is within the non-display period and as long as it takes place after the display state of the pixels corresponding to scanning electrodes last selected has been switched to the non-lit-up state; therefore, the timing is synchronized with the inter non-display period signal after a period required for setting the non-lit-up state has elapsed. The application of this timing allows the pixels that were lit up prior to the last lit-up-state of pixels to be inevitably switched to the non-lit-up state.

In this manner, the non-display period is provided within one frame period, and after the entire surface has been switched to the non-lit-up state, the display elements are turned off so that it becomes possible to prevent the dc voltage from being applied to the display elements.

In order to achieve the above-mentioned objective, the driving method for a display device of the present invention is characterized in that the timing in which the application of the above-mentioned selection voltage to the scanning electrodes and the application of the above-mentioned data signal voltage to the data electrodes are stopped is set to be synchronous to the scanning start signal of one frame.

In the above-mentioned invention, the timing in which the application of the above-mentioned selection voltage to the scanning electrodes and the application of the above-mentioned data signal voltage to the data electrodes are stopped is synchronized by the scanning start signal that determines the start of scanning of one frame. In other words, the scanning start signal is utilized as the inter non-display period signal that allows the timing for making the display turn off to be synchronized. The application of the scanning start signal makes it possible to prevent the dc voltage from being applied to the scanning electrodes.

Therefore, a simpler driving method can be provided by utilizing the existing signal, in an attempt to turn off the display after the display elements have been switched to the non-lit-up state over the entire surface.

In order to achieve the above-mentioned objective, the driving method for a display device of the present invention is characterized in that the timing in which the application of the above-mentioned selection voltage to the scanning electrodes and the application of the above-mentioned data signal voltage to the data electrodes are stopped is set to be synchronous to the start of one selection period for the scanning electrodes.

In the above-mentioned invention, the timing in which the application of the above-mentioned selection voltage to the scanning electrodes and the application of the above-mentioned data signal voltage to the data electrodes are stopped is synchronized by the signal such as a scanning clock that determines the start of one selection period for the scanning electrodes. In other words, the signal for determining the start of one selection period is utilized as the inter non-display period signal that allows the timing for making the display turn off to be synchronized. The application of such a signal makes it possible to prevent the dc voltage from being applied to the display elements.

Therefore, a simpler driving method can be provided by utilizing the existing signal, in an attempt to turn off the display after the display elements have been switched to the non-lit-up state over the entire surface.

Moreover, in order to achieve the above-mentioned objective, the driving method for a display device of the present invention is characterized in that, upon detection of the power-supply signal, a controlling process is started so as to switch the display elements to the non-lit-up state over the entire surface, and in that after a period of time not less than the response time of the display device has elapsed since the start of the controlling process for the non-lit-up state of the pixels corresponding to the scanning electrodes that were lastly selected prior to the above-mentioned control, the application of the above-mentioned selection voltage to the scanning electrodes and the application of the above-mentioned data signal voltage to the data electrodes are stopped.

In the above-mentioned invention, upon detection of the power-supply signal indicating that the power supply of the display device is to be turned off, the controlling process is started so as to switch the display elements to the non-lit-up state over the entire surface. The controlling period for the non-lit-up state over the entire surface is set to last up to a point of time during which the predetermined period of time not less than the response time of the display device has elapsed since the start of the controlling process for the non-lit-up state of the pixels corresponding to the scanning electrodes that were lastly selected prior to the above-mentioned control, that is, since the start of the controlling process for the non-lit-up state of the pixels that were selected last through the line sequential scanning after the start of the controlling process.

In other words, even in the case when the control for switching the pixels in the lit-up state to the non-lit-up state is started, since there is a delay in response time before the quantity of charge corresponding to the non-lit-up state has actually been achieved, the controlling process for the non-lit-up state over the entire surface is carried out on all the pixels for a period exceeding the response time so as to provide the non-lit-up display over the entire surface, and the application of the above-mentioned selection voltage to the scanning electrodes and the application of the above-mentioned data signal voltage to the data electrodes are stopped, thereby turning the display off.

With this arrangement, the pixels maintained in the lit-up display state prior to the turning off of the display elements can be switched to the non-lit-up display state in a stable manner.

In order to achieve the above-mentioned objective, the driving method for a display device of the present invention is preferably arranged so that the display elements are maintained in the non-lit-up display state over the entire surface up to completion of a period corresponding to a predetermined number of frames after the frame in which the power-supply signal has been detected.

In the above-mentioned invention, in the case when a power-supply signal instructing the turning off of the power supply of the display device has been detected in a certain frame period, the display elements are switched to the non-lit-up display over the entire surface up to completion of a period corresponding to -a predetermined number of frames starting from the next frame. In this manner, the control period including the response time having changes in display states is completed in synchronized timing with the switching of frames; thus, it becomes possible to easily control the non-lit-up display over the entire surface.

In order to achieve the above-mentioned objective, the driving method for a display device of the present invention is preferably designed so that the predetermined number of frames is set as an even number.

In the above-mentioned invention, in the case when an inverted selection voltage is applied to pixels for each frame, with an arrangement in which the predetermined number of frames is set to an even number, since the voltage values and polarities, applied to all the pixels, are cancelled in a time-averaging manner, it is possible to prevent degradation in the liquid crystal to a minimum.

In order to achieve the above-mentioned objective, the driving method for a display device of the present invention is preferably designed so that during a period corresponding to a predetermined number of frames after the detection of the power-supply signal, prior to the non-lit-up display over the entire surface of the display elements, the display elements are switched to the lit-up display over the entire surface.

In the above-mentioned invention, after the power-supply signal instructing the turning off of the power supply of the display device, the lit-up display over the entire surface is provided for a predetermined number of frames prior to the start of the control for the non-lit-up display over the entire surface. With this arrangement, after charges corresponding to the lit-up-display have been accumulated on all the pixels uniformly, the charges are reduced to the quantities of charge corresponding to the non-lit-up display; thus, since the quantity of charge of the display panel becomes uniform on all the pixels after the non-lit-up display over the entire surface has been provided, it becomes possible to positively eliminate remaining images.

Furthermore, in order to achieve the above-mentioned objective, the liquid crystal display of the present invention, which is provided with a plurality of scanning electrodes and a plurality of data electrodes that are arranged in directions so as to intersect each other, liquid crystal display elements of a reflection type having respective pixels which are arranged in a matrix format and have their display state determined by controlling a quantity of charge, and switching elements installed in the respective pixels, for switching a charging current to the pixels, is characterized in that, with respect to the scanning electrodes, selection is line-sequentially made for each frame period and a selection voltage is applied thereto, and to the data electrodes is applied a data signal voltage corresponding to a display state, so that the pixels are charged. In this liquid crystal display, when a power-supply signal indicating that the power supply of the display device is to be turned off is detected, after all the pixels have been switched to the non-lit-up state, the application of the above-mentioned selection voltage to the scanning electrodes and the application of the above-mentioned data signal voltage to the data electrodes are preferably stopped.

In the above-mentioned invention, since the driving method for a display device of the present embodiment is applied to reflection-type liquid crystal display elements, the turning off of the display is performed after the liquid crystal display elements have been switched to the non-lit-up state over the entire surface; thus, no image patterns appear even if external light is directed onto the liquid crystal display element after the power-supply of the liquid crystal display has been turned off. Therefore, a strong remaining image after the turning off of the power supply, which is inherently caused on the conventional external light utilizing display, can be eliminated.

For a fuller understanding of the nature and advantages of the invention, reference should be made to the ensuing detailed description taken in conjunction with the accompanying drawings.

DESCRIPTION OF THE EMBODIMENTS

Embodiment 1

Figure 1:
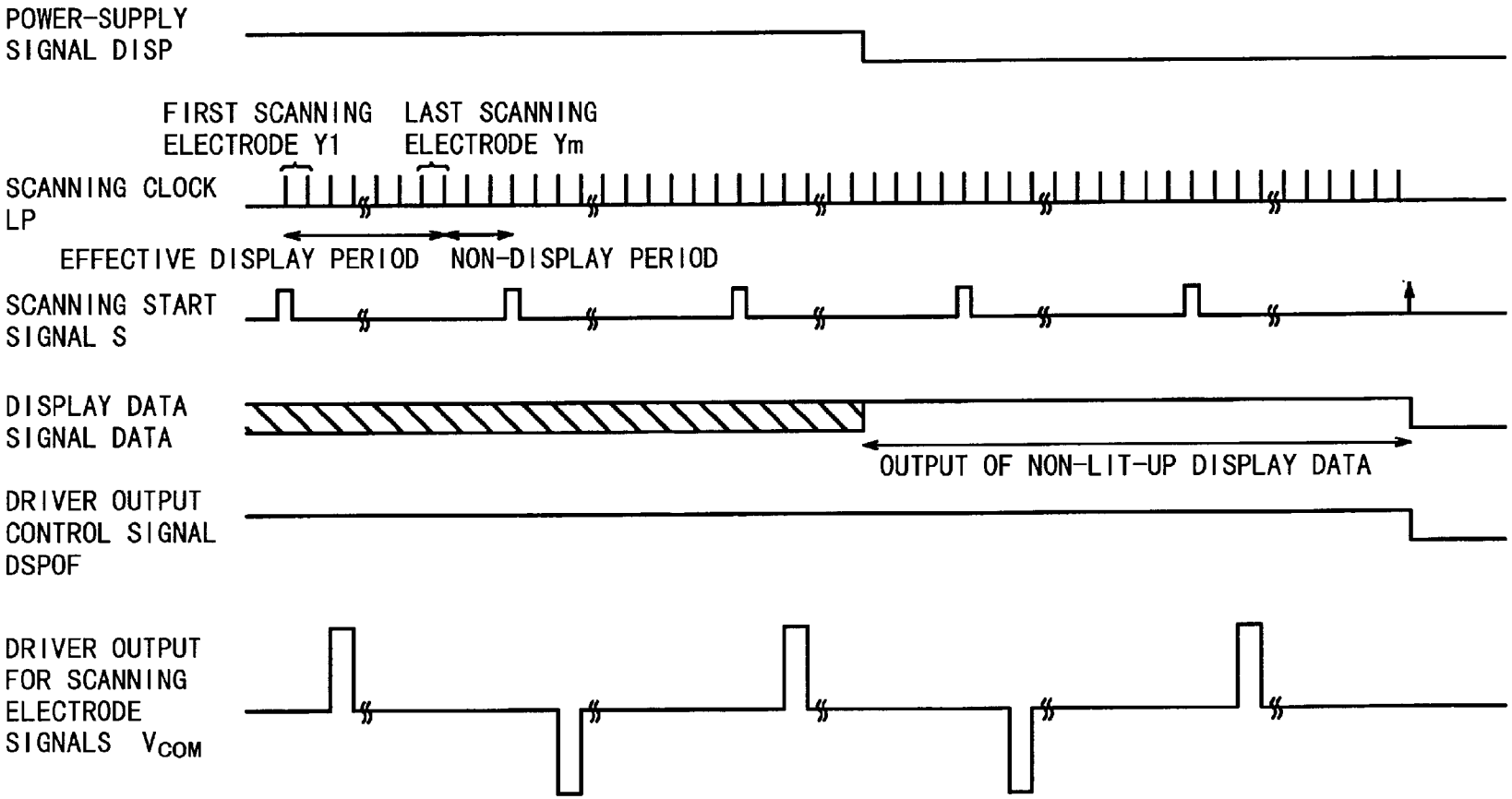
FIG. 1 is a timing chart showing signals used in a driving method of a display device in accordance with one embodiment of the present invention.
Figure 2:
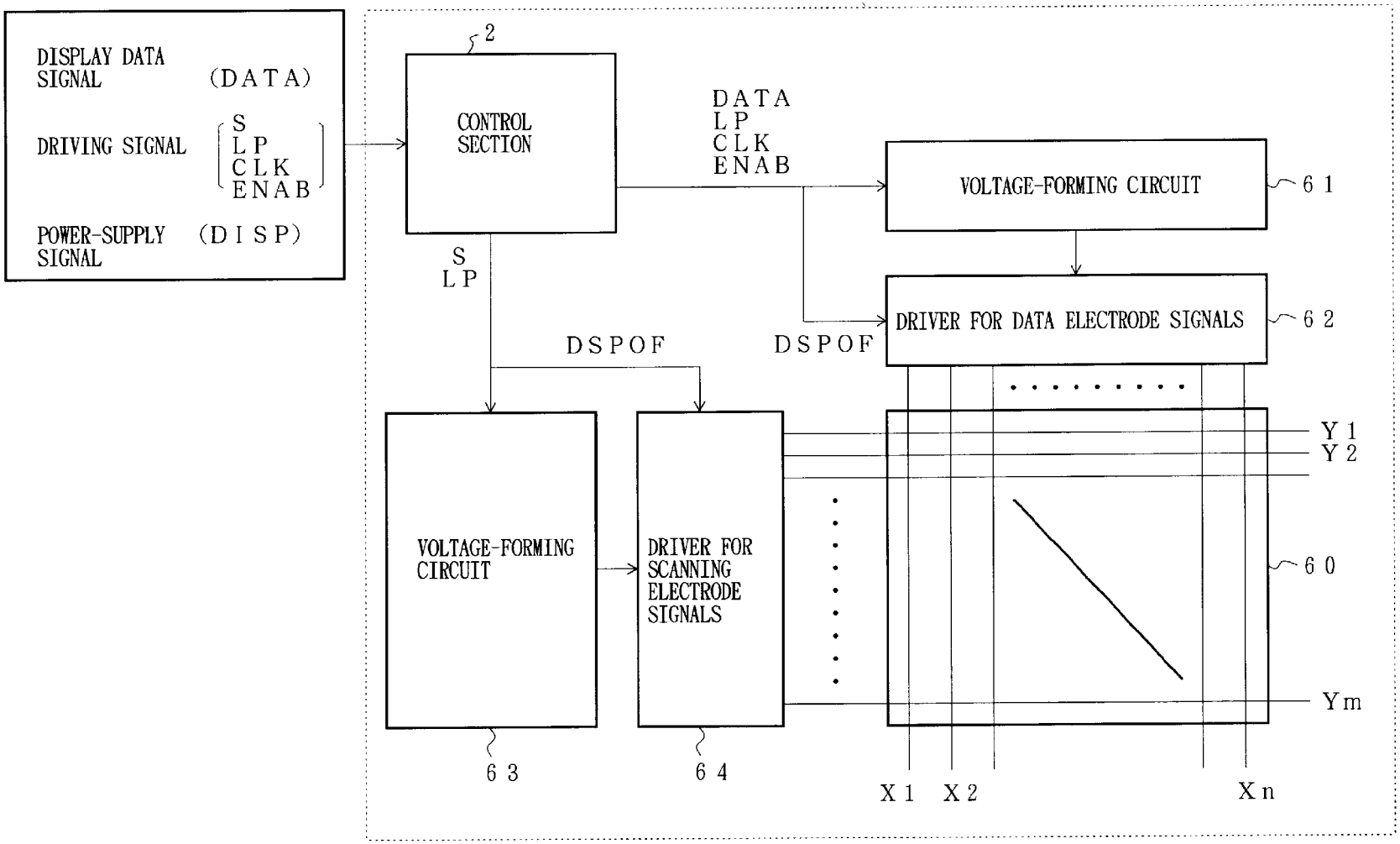
FIG. 2 is a block diagram that shows the structure of a liquid crystal display to which the driving method of the display device of FIG. 1 is applied.
Figure 3:
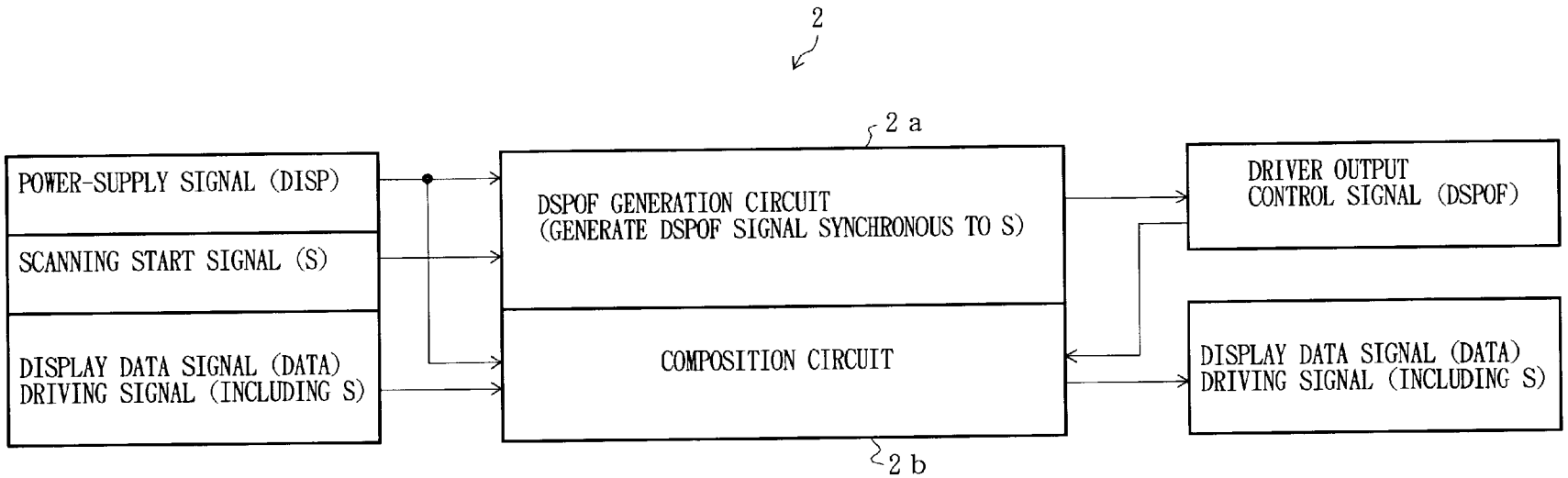
FIG. 3 is a block diagram that shows the structure of a control section of the liquid crystal display of FIG. 2.

Referring to FIGS. 1 through 3, the following description will discuss one embodiment of a driving method for a display device of the present invention and a liquid crystal display using such a driving method.

Figure 6:
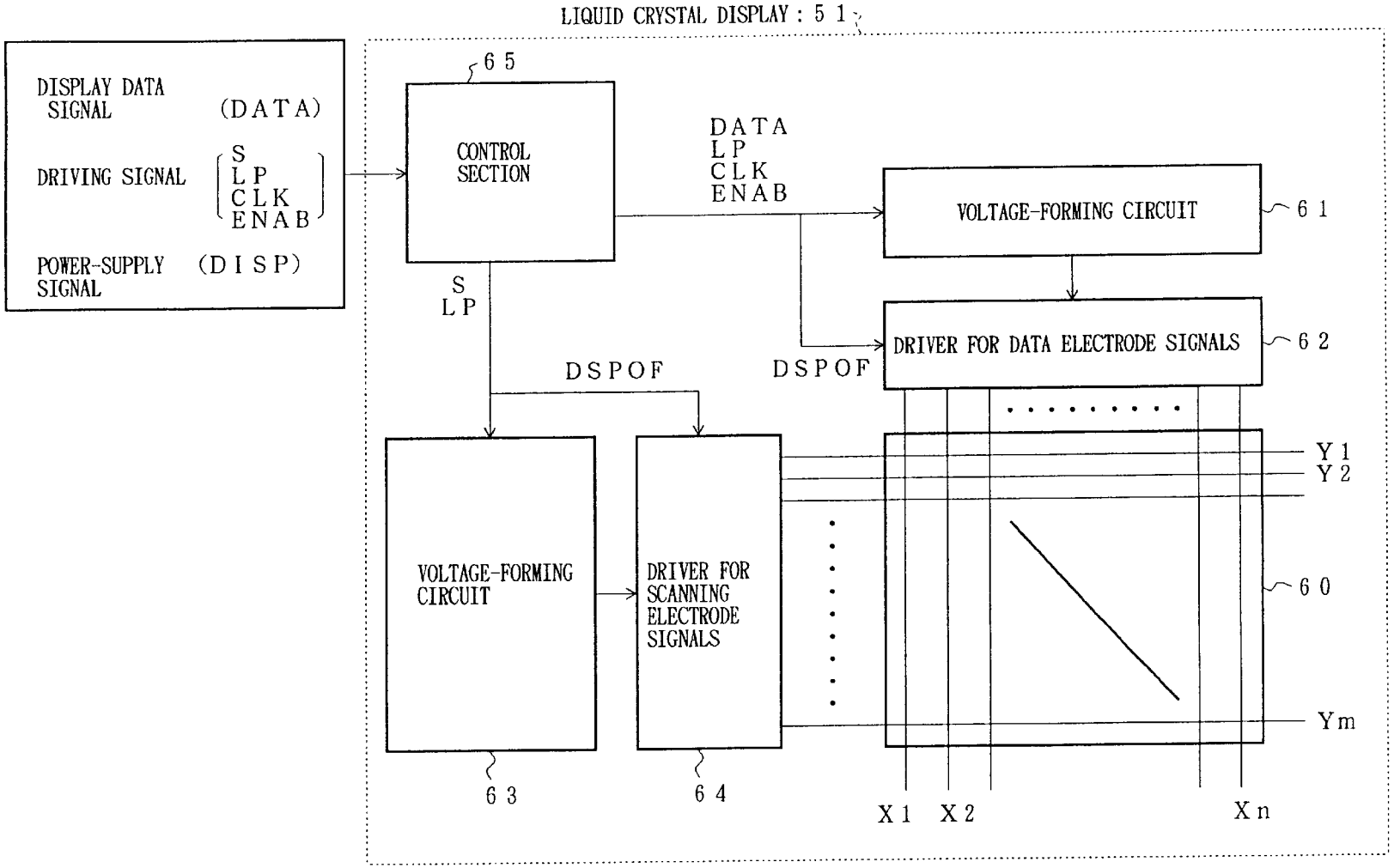
FIG. 6 PRIOR ART
FIG. 6 is a block diagram that shows the structure of a conventional display device.
Figure 7:
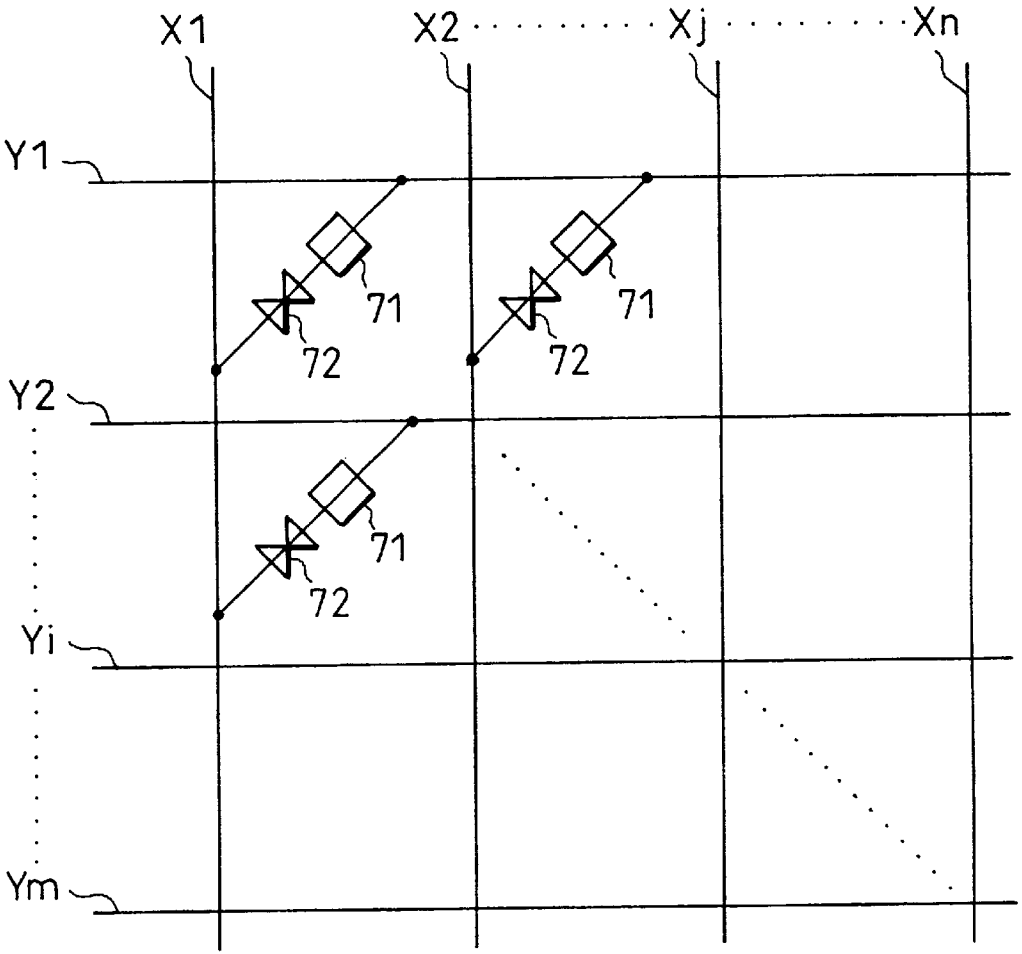
FIG. 7 PRIOR ART
FIG. 7 is an equivalent circuit diagram that shows the structure of a display panel of the display device.
Figure 8:
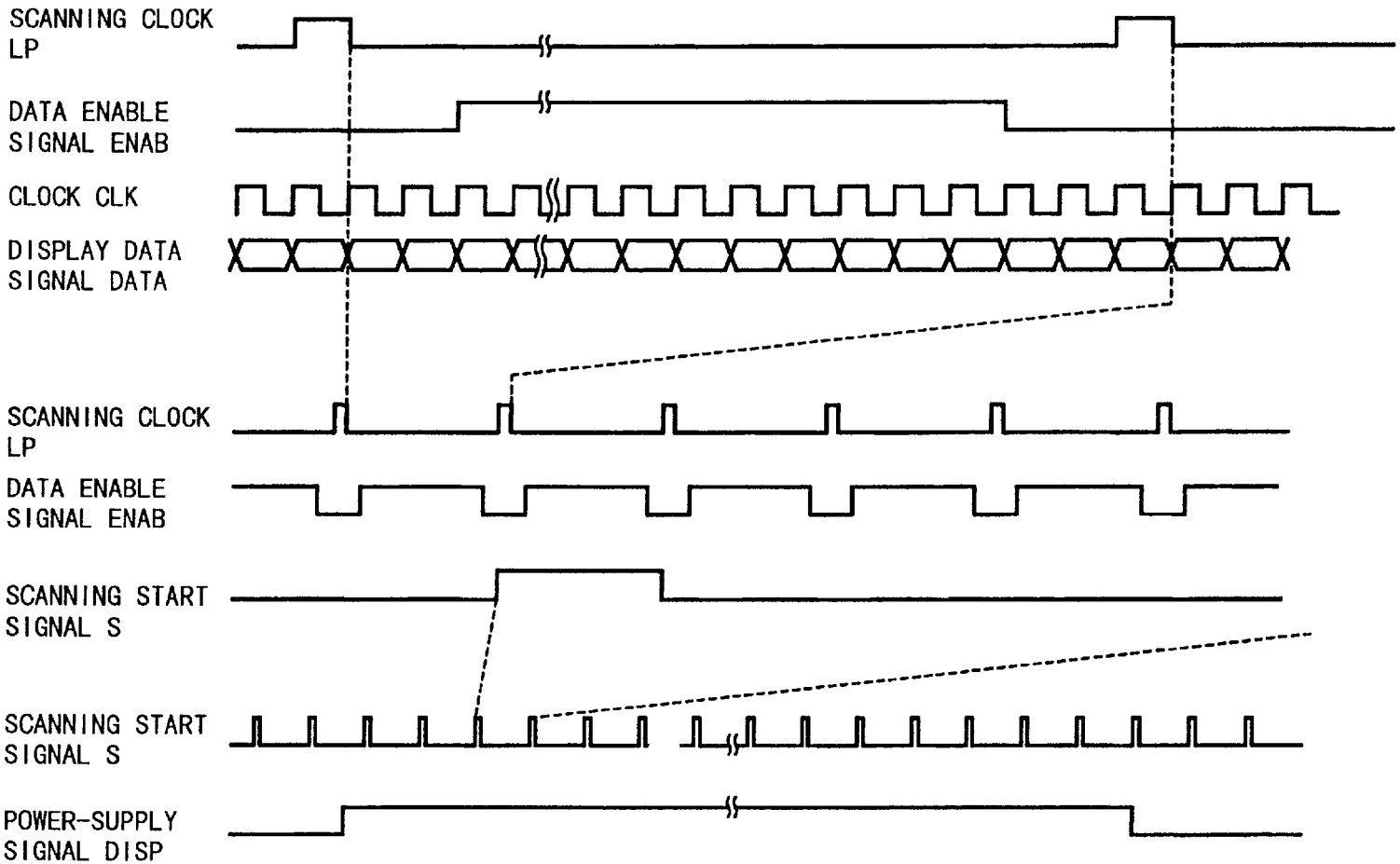
FIG. 8 PRIOR ART
FIG. 8 is a timing chart showing signals used in a driving method applied to the display device.
Figure 9:
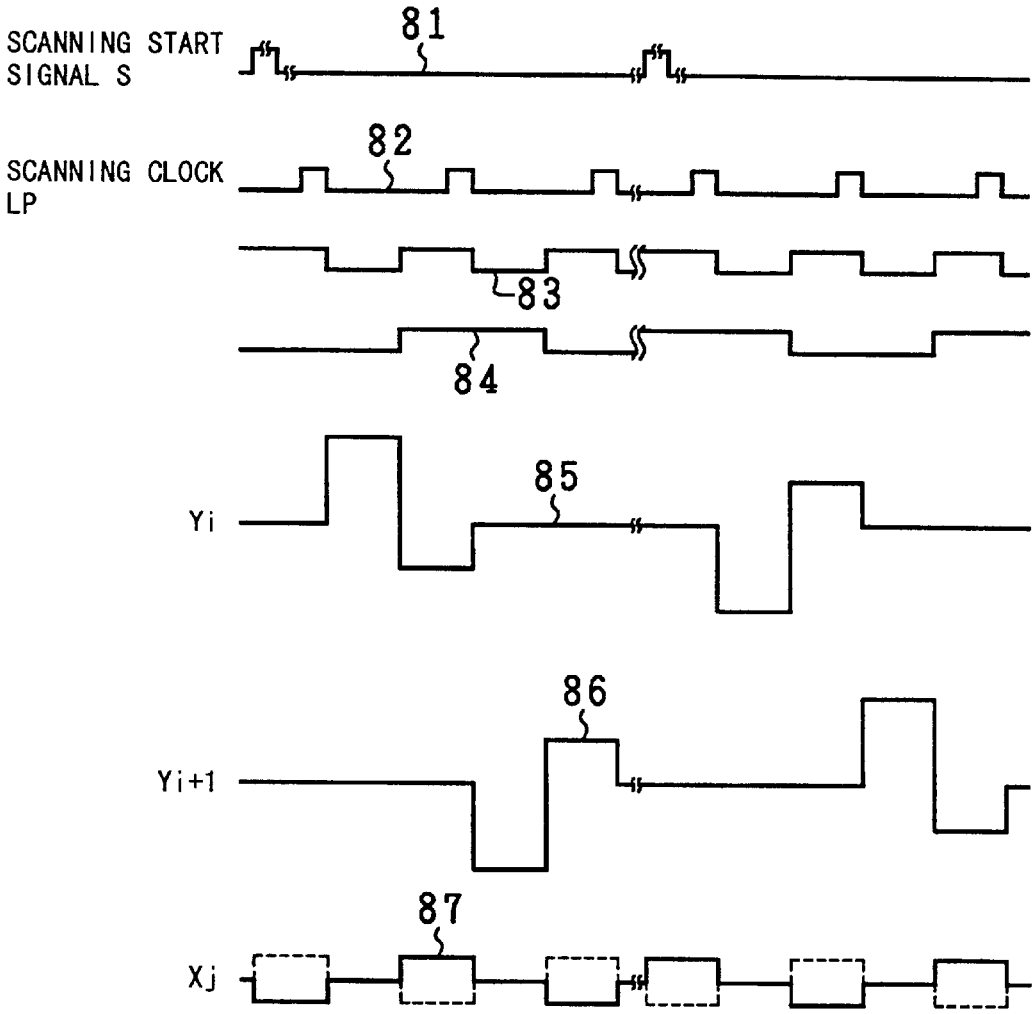
FIG. 9 PRIOR ART
FIG. 9 is a timing chart showing signals used in a driving method applied to another display device.
Figure 10:
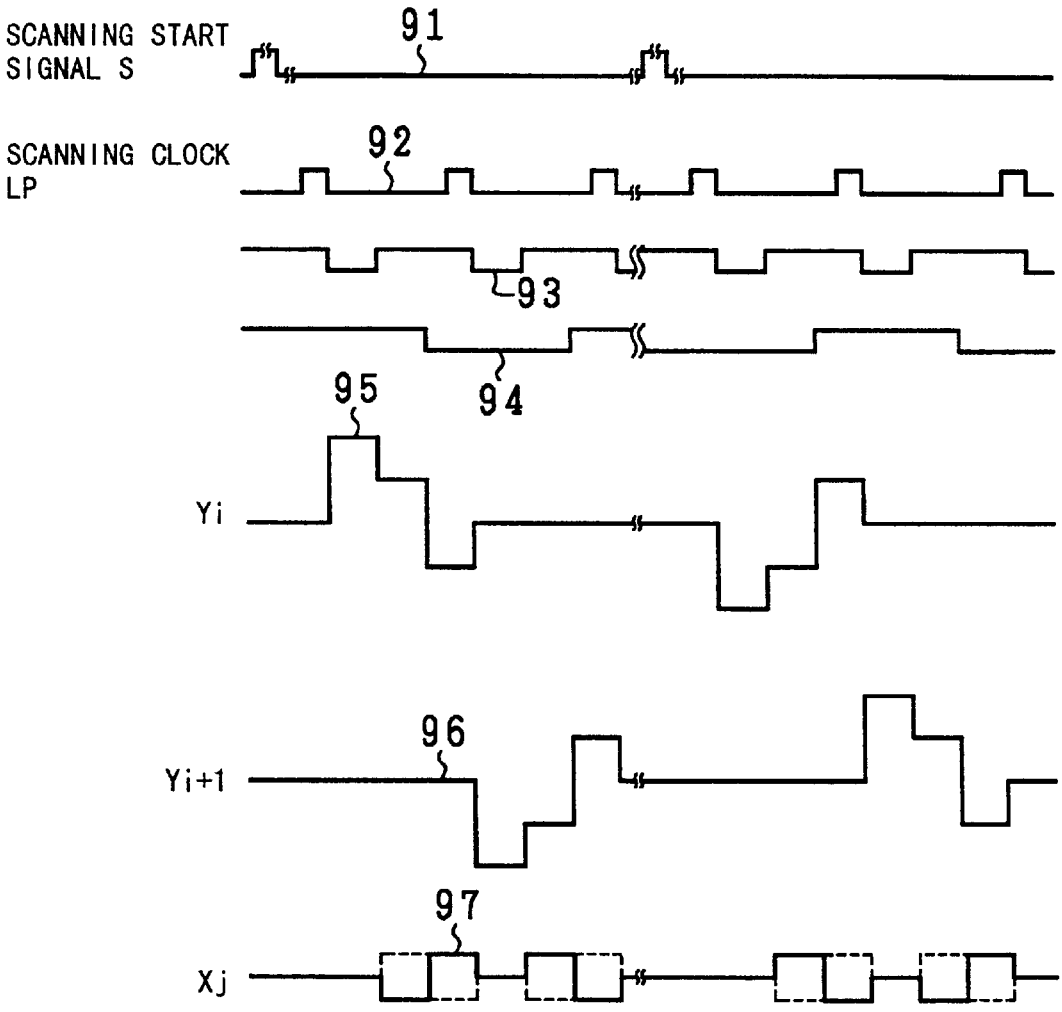
FIG. 10 PRIOR ART
FIG. 10 is a timing chart showing signals used in a driving method applied to still another display device.
Figure 11:
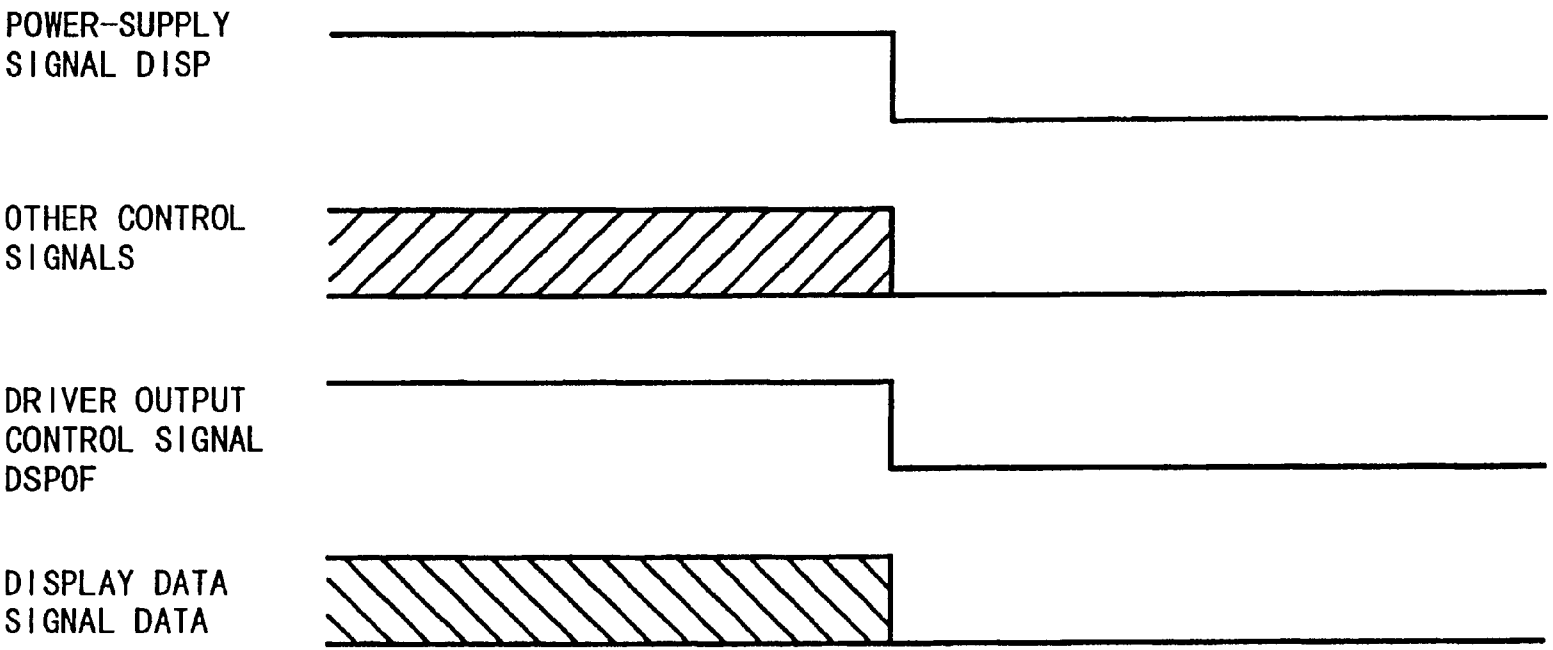
FIG. 11 PRIOR ART
FIG. 11 is a timing chart showing the relationship of signals that are used upon turning off the power supply of the display device of FIG. 6.
Figure 12:
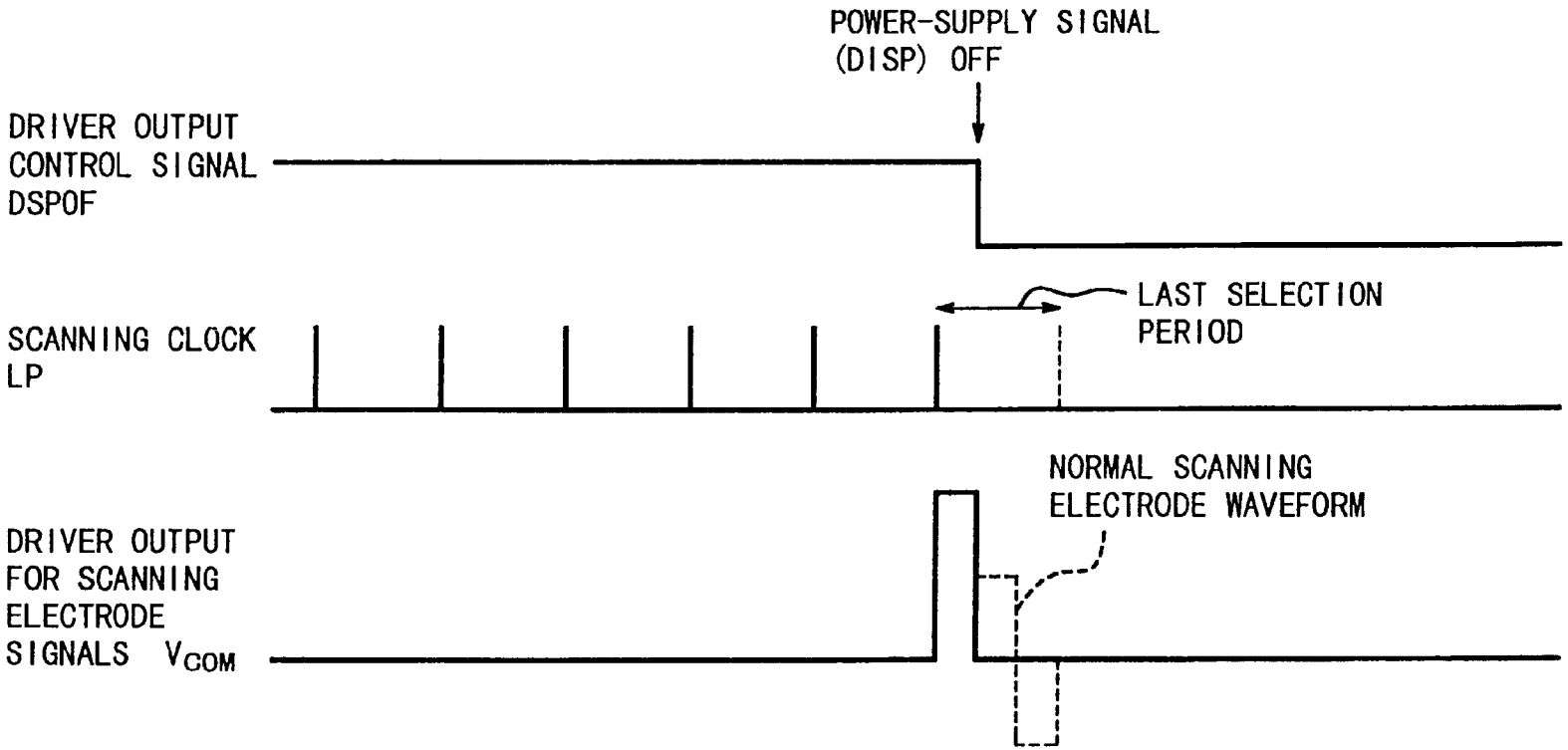
FIG. 12 PRIOR ART
FIG. 12 is a timing chart showing the relationship of signals that are used upon turning off the power supply of the display device driven by using the driving method of FIG. 9.
Figure 13:
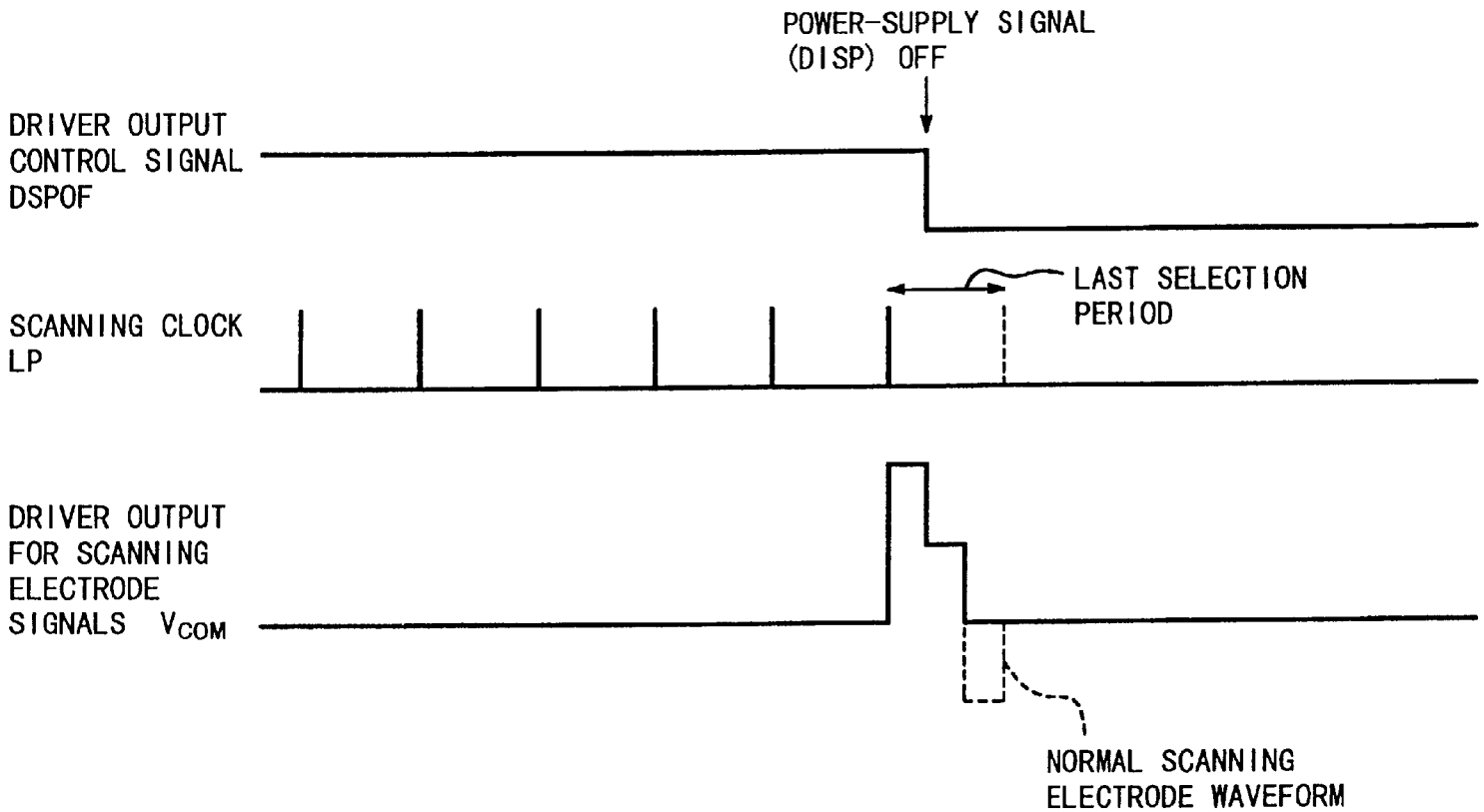
FIG. 13 PRIOR ART
FIG. 13 is a timing chart showing the relationship of signals that are used upon turning off the power supply of the display device driven by using the driving method of FIG. 10.

FIG. 2 shows the structure of a liquid crystal display 1 to which the driving method for a display device of the present invention is applied. The liquid crystal display 1 serving as a display device is constituted by a display panel section 60, a voltage-forming circuit 61 (driving circuit), a driver 62 (driving circuit) for data-electrode signals, a voltage-forming circuit 63 (driving circuit), a driver 64 (driving circuit) for scanning-electrode signals, data electrodes Xj (j=1, 2, . . . , n), scanning electrodes Yi (i=1, 2, . . . , m) and a control section 2. Although the structures except the control section 2 are the same as those shown in FIGS. 6 and 7, the control section 2 features a specific construction for carrying out a driving method which will be described later.

More specifically, the liquid crystal display 1 is provided with a display panel section 60 having a structure in which a liquid crystal layer is sandwiched by a pair of substrates. More specifically, as indicated by an equivalent circuit in FIG. 7, the display panel section 60 has an arrangement in which two-terminal elements 72 and liquid crystal display elements 71 (display elements) are series-connected for each unit area between a plurality of scanning electrodes Yi (i=1, 2, . . . , m) that are arranged in directions so as to intersect each other, and areas corresponding the respective liquid crystal display elements 71 are arranged in a matrix format as pixels.

A driver 64 for scanning-electrode signals selects the respective scanning electrodes Yi in a line-sequential manner for each frame period and applies a predetermined selection voltage thereto, and is normally constituted by a control section, shift registers, analog switches, etc. A driver 62 for data-electrode signals applies a predetermined data signal voltage corresponding to display data to respective data electrodes Xj that are in the selection period. Thus, the selection voltage and the data signal voltage are applied to the respective pixels during the selection period. A voltage difference between the selection voltage and the data signal voltage allows a charge corresponding to the display data to be adjusted. This charge is maintained by the two-terminal elements 72 until the next selection period so that the display state is maintained during one frame period. In other words, the display state is desirably controlled on the display panel section 60 by applying predetermined voltages to the respective ends of each pixel. Then, the respective pixels are switched to a lit-up state (driven state) when the accumulated charge reaches not less than a predetermined value, and also switched to a non-lit-up state (non-driven state) when the charge has been drawn to reach not more than a predetermined value.

As illustrated in FIG. 3, the control section 2 is provided with a DSPOF generation circuit 2*a* and a composition circuit 2*b*. A power-supply signal DISP and a scanning start signal S are inputted to the DSPOF generation circuit 2*a*, and the power-supply signal DISP, a display data signal DATA, and driving signals such as a scanning start signal S and a scanning clock signal LP are inputted to the composition circuit 2*b*. The DSPOF generation circuit 2*a* turns a driver output control signal DSPOF on (High level) when the power-supply signal DISP is turned on (High level). At this time, the control section 2 makes an output with the display data signal DATA and the driving signal being inputted thereto.

The composition circuit 2*b* composes the display data DATA and the power-supply signal DISP, thereby outputting the display data DATA as lit-up display data and non-lit-up display data. In order to turn the power supply of the liquid crystal display 1 off (that is, in order to turn off the voltage-forming circuit 61, the driver 62 for data electrode signals, the voltage-forming circuit 63, the driver 64 for scanning electrode signals, etc.), when the power-supply signal DISP is turned off (Low level) from an on-state, the display data DATA is made to be non-lit-up display data by the composition circuit 2*b*, with the result that the control section 2 outputs non-lit-up display data. In other words, the liquid crystal display 1 starts the non-lit-up display, following the turning off of the power-supply signal DISP. Moreover, the composition circuit 2*b* composes the driving signal and the non-lit-up display data as well as the driver output control signal DSPOF, thereby stopping the supplies of the driving signal and the non-lit-up display data.

Referring to the timing chart of FIG. 1, an explanation will be given of the operation in accordance with the above-mentioned driving method. In the case when the power-supply signal DISP of the liquid crystal display 1 is in an on-state, after the scanning start signal S has gone high, a scanning process for one frame period is started in synchronism with a fall of the scanning clock LP, thereby successively applying a voltage to the respective scanning electrodes Yi. The cycle of the scanning clock LP corresponds to one selection period of the scanning electrodes Yi, and as illustrated in the Figure, the scanning is line-sequentially made from the leading scanning electrode Yl to the last scanning electrode Ym so that signals corresponding to the display data signals DATA are supplied to the data electrodes Xj. During the selection period of the scanning electrodes Yi, a selection voltage (driver output for scanning electrode signals) $V_{COM}$, which is inverted for each frame, for example, as shown in the Figure, is applied to the scanning electrodes Yi from the driver 64 for scanning electrode signals. In this manner, the display state is determined for each pixel, and this period (Yi to Ym) forms an effective display period during one frame period.

After the effective display period, a non-display period, which is not related to display, is provided. This non-display period is a period in which none of the selection voltage and data signal voltage are outputted, or even if they are outputted, none of them devote to display since they are not connected to the scanning electrodes Yi, and in which none of the scanning electrodes Yi are selected. When explained by reference to FIG. 1, this corresponds a case in which a scanning electrode Ym+1, which is not related to display, is hypothetically set after the effective display period.

Immediately before the completion of the non-display period, the scanning start signal S is allowed to rise, and the timing of its fall is made coincident with the timing of a rise of the scanning clock LP for determining the scanning start of the leading scanning electrode Y1 in the next frame. Thus, the frame consisting of added periods of the above-mentioned effective display period and non-display period is repeated so that the display states of the respective pixels are determined.

Here, in the case when a turning-off operation of the power supply of the liquid crystal display 1 is performed in the middle of a certain frame, the power-supply signal DISP is switched from ON state to OFF state so that the transition to the turning-off of the power supply is detected, and the above-mentioned control section 2 controls so that the display data signal DATA to the display panel section 60 is made to be non-lit-up display data.

At this time, the non-lit-up display is performed until the driver output control signal DSPOF is turned off. Therefore, after a lapse of a sufficient period of time since the last selection period in the lit-up display, the application of the selection voltage to the scanning electrode Yi and the application of the data signal voltage to the data electrode Xj are stopped, thereby turning off the display of the display panel section 60, that is, after the accumulated charges of the pixels that were in the lit-up state have been reduced to the quantity of charge in the non-lit-up state, the display is turned off; therefore, no remaining image is caused even when the power-supply signal DISP is turned off in any timing. Moreover, since the non-display period is formed in one frame period, the display panel section 60 is easily switched to the non-lit-up display over the entire surface, and the display elements can be turned off within the non-display period. Thus, it is possible to prevent an abnormal dc voltage from being applied to the display panel section 60 at the time of turning the power supply off, and consequently to prevent degradation in the liquid crystal.

With respect to the timing for turning the display off, any timing may be adopted as long as it is taken within the non-display period and it is also taken after the accumulated charges of the pixels corresponding to the scanning electrodes Yi that were selected lastly have reduced from the quantity of charge of the lit-up-state to the quantity of charge in the non-lit-up state. Therefore, the timing in which the display is turned off is made synchronous to the inter non-display period signal that takes place after a lapse of a period required for the pixels corresponding to the scanning electrodes Yi that were selected lastly to enter the non-lit-up state. The application of this timing allows the pixels that were lit up prior to the last lit-up-state of pixels to be inevitably switched to the non-lit-up state.

Therefore, in a liquid crystal display having the same construction as described above, with respect to the inter non-display period signal for determining timing in which the display of the display panel section 60 is turned off, another signal, such as the scanning clock LP existing within the non-display period, may be utilized instead of the scanning start signal S. Such a signal only needs to rise within the non-display period after the pixels that were in the lit-up state have been switched to the non-lit-up state. In this manner, it is possible to provide a simpler driving method by utilizing an existing signal that takes place simultaneously with the start of the scanning of one frame or prior to the start of the scanning thereof, such as the scanning start signal S and the scanning clock signal LP. Of course, it is possible to generate a new signal that satisfies the above-mentioned conditions within the non-display period so as to turn the display of the display panel section 60 off.

This idea is extended to an arrangement in which, not particularly limited to the position of the non-display period provided within the one frame period, it is possible to utilize a pulse that takes place simultaneously with the start of one selection period of the scanning electrodes Yi or prior to the start of one selection period thereof, such as the scanning clock for determining the start of one selection period of the scanning electrodes Yi and the horizontal synchronous signal, so as to turn the display of the display panel section 60 off. The above-mentioned pulse is allowed to rise before new display data is written in the pixels in the next selection period following a non-display period; therefore, the rise is set within the non-display period, and synchronizing to the rise, the display of the display panel section 60 is turned off. This arrangement also provides a simpler driving method by utilizing an existing signal. Of course, in the same manner as described above, it is possible to generate a new signal that satisfies the above-mentioned conditions within the non-display period so as to turn the display of the display panel section 60 off.

Moreover, the driving method for a display device of the present embodiment may be applied to a liquid crystal display having reflection-type liquid crystal display elements. In this arrangement, since the turning off of the display is performed after the liquid crystal display elements have been switched to the non-lit-up state over the entire surface, no image patterns appear even if external light is directed onto the liquid crystal display element after the power-supply of the liquid crystal display has been turned off. Therefore, a strong remaining image after the turning off of the power supply, which is inherently caused on the conventional external light utilizing display, can be eliminated; thus, it is possible to obtain great effects.

Embodiment 2

Figure 4:
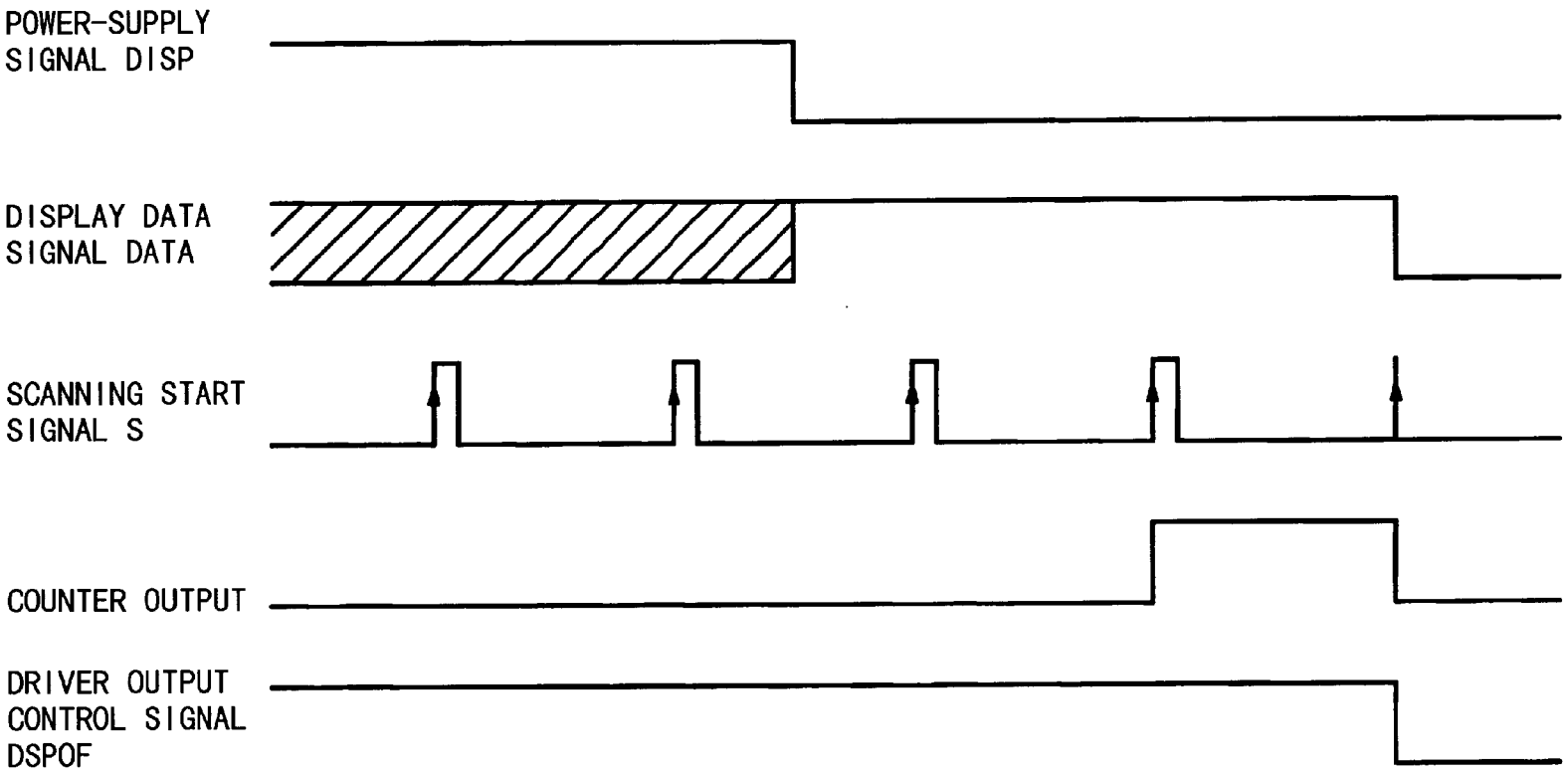
FIG. 4 is a timing chart showing signals used in a driving method of a display device in accordance with another embodiment of the present invention.
Figure 5:
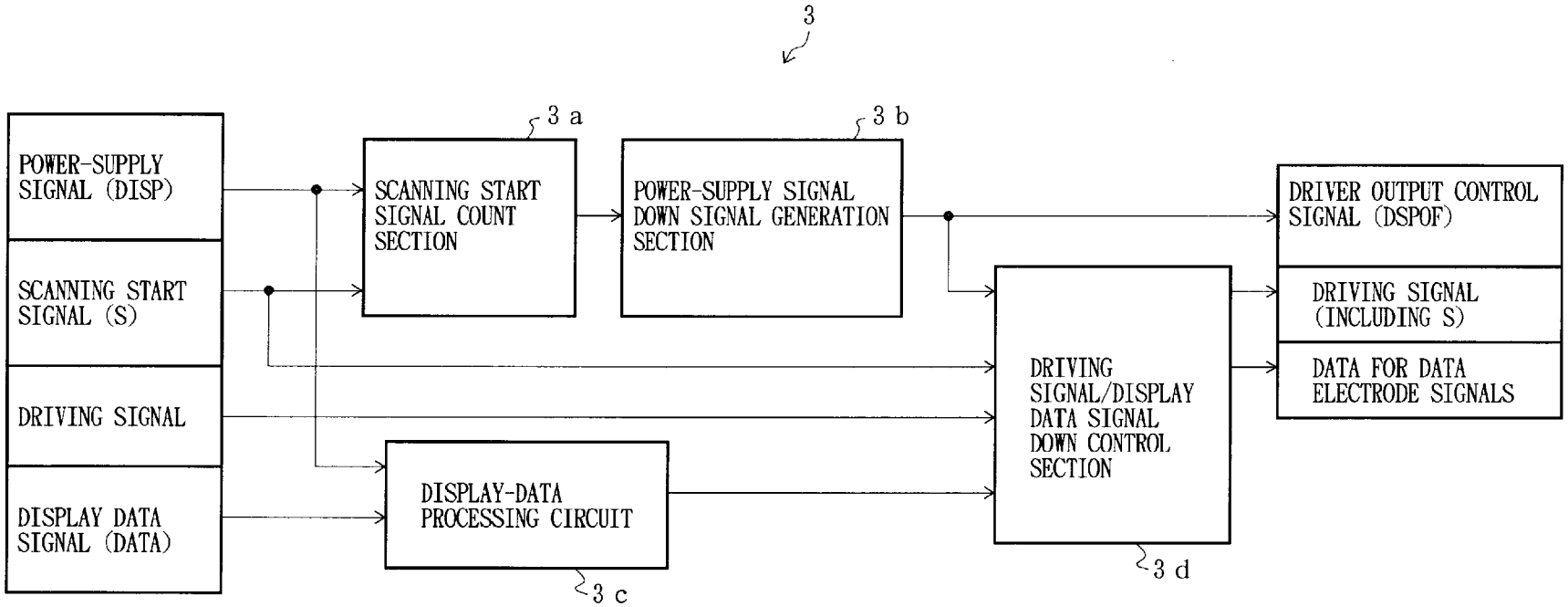
FIG. 5 is a block diagram that shows the structure of a control section of a liquid crystal display to which the driving method of the display device of FIG. 4 is applied.

Referring to FIGS. 4 and 5, the following description will discuss another embodiment of a driving method for a display device of the present invention, and a liquid crystal display using such a driving method. Here, in the present embodiment, those members that have the same functions and that are described in Embodiment 1 are indicated by the same reference numerals and the description thereof is omitted.

The liquid crystal display to which the driving method for a display device of the present embodiment is applied has the same arrangement as that of the liquid crystal display 1 described in Embodiment 1, except that another control section 3 having an arrangement different from the control section 2 is provided; therefore, the drawing that shows the entire liquid crystal display is omitted.

FIG. 5 shows one portion of the arrangement of the control section 3. The control section 3 is constituted by a scanning start signal count section 3*a*, a power-supply signal down signal generation section 3*b*, a display data processing circuit 3*c* and a driving signal/display data signal down control section 3*d*. The power-supply signal DISP and the scanning start signal S are inputted to the scanning start signal count section 3*a*. The scanning start signal count section 3*a* is a circuit for generating a pulse waveform that goes high for one frame period, after counting a predetermined number n with respect to the scanning start signal S since the power-source signal DISP has been switched from ON state (High level) to OFF state (Low level). By using a pulse generated in the scanning start signal count section 3*a* and the power-supply signal DISP, the power-supply signal down signal generation section 3*b* generates a driver output control signal DSPOF having a waveform that is allowed to switch from ON state (High level) to OFF state (Low level) in synchronized timing with a rise of the scanning start signal S after a lapse of n frames corresponding to the predetermined number n since the power-supply signal DISP has been turned off; and this signal is used for output control of the driver 62 for data-electrode signals and the driver 64 for scanning-electrode signals.

The power-supply signal DISP and the display data signal DATA are inputted to the display data processing circuit 3*c*. When the power-supply signal DISP is in ON state, the display data processing circuit 3*c* outputs the inputted display data signal DATA as it is, and when the power-supply signal DISP is in OFF state, it outputs the display data signal DATA as a High level signal all the time. The driver output control signal DSPOF, generated and outputted by the power-supply signal down signal generation section 3*b*, the driving signals including the scanning start signal S and the display data signal DATA that has been processed and outputted by the display data processing circuit 3*c* are inputted to the driving signal/display data signal down control section 3*d*. When the driver output control signal DSPOF is in ON state, the driving signal/display data signal down control section 3*d* outputs the inputted driving signal and the display data signal DATA from the display data processing circuit 3*c*, as they are, as data used for data electrode signals, and simultaneously as the driver output control signal DSPOF switches from ON state to OFF state, provides control so as to shut down the driving signal and the display data signal DATA (data used for data electrode signals) with High level.

Operation signals, shown in the processing system of FIG. 5, are indicated by the timing chart of FIG. 4. When the power-supply signal DISP is maintained in ON state, the driving signals including the display data signal DATA and the scanning start signal S are outputted, as they are, with waveforms externally supplied thereto. When the power-supply signal DISP switches from ON state to OFF state, the display data signal DATA is at once fixed to High level. Here, supposing that the non-lit-up display is attained when the display data signal DATA of High level is applied to the pixels in the display panel section 60, the display image is turned off over the entire surface, that is, a white display is attained in a liquid crystal display of the normally white mode. Here, a driver output control signal DSPOF, which switches from ON state to OFF state upon detection of a rise in the scanning start signal S that is counted every predetermined number of n+1, is generated, and in synchronism with this signal, the driving signal and the display data signal DATA with High level are also turned OFF. Since the predetermined number n is an arbitrary number, the output period of the non-lit-up display data can be desirably set in the present embodiment.

Therefore, the last selected scanning electrode is always the scanning electrode Ym, and the period of the entire-surface white display is set to a period obtained by adding the period from the turning off of the power-supply signal DISP to the rise of the next scanning start signal S and a frame period. In this manner, by setting the entire-surface white display longer, the time it takes for the display of the display panel section 60 to be turned off is allowed to sufficiently exceed the response time of the liquid crystal display in which the pixels in the lit-up state are switched to the non-lit-up state; therefore, it is possible to solve the problem of remaining images due to the charge-retaining characteristic of the two-terminal elements placed in the respective pixels. Moreover, since the display panel section 60 is not susceptible to an abnormal dc voltage immediately after the turning off of the power supply, it is possible to prevent degradation in the liquid crystal.

Here, the period in which the display panel section 60 is maintained in the non-lit-up state over the entire surface after turning off of the power-supply signal DISP is not limited to the above-mentioned example; and it may be set to any period, as long as it is not less than the response time required for the accumulated charge of the pixels to be reduced from the quantity of charge corresponding to the lit-up display to the quantity of charge corresponding to the non-lit-up display. After the lapse of the response time, a constant state is achieved after the lapse of a transient period from the start of the control for the non-lit-up display to the arrival of the actual non-lit-up display; thus, it is possible to switch the pixels in the lit-up state to the non-lit-up state in a stable manner.

Therefore, as long as the display of the display panel section 60 is turned off in this constant state, the off timing of the display may be desirably set on a frame basis, for example, in the following manner: The predetermined number n of the scanning start signal count section 3*a* is changed so that, in addition to the rest of period in the frame from which the OFF state of the power-supply signal DISP has been detected, a period up to the completion of a period corresponding to a predetermined number of frames starting from the next frame is set as the non-lit-up display period over the entire surface.

In this manner, the control period for the non-lit-up display over the entire surface including the response time is completed in synchronized timing with the switching of frames; thus, it becomes possible to easily control the non-lit-up display over the entire surface.

In particular, with an arrangement in which the predetermined number of frames is set to an even number such as two, as described in the present embodiment, in the case when an inverted selection voltage is applied to pixels for each frame, since the voltage values and polarities, applied to all the pixels, are cancelled in a time-averaging manner, it is possible to prevent degradation in the liquid crystal to a minimum.

Moreover, after the OFF of the power-supply signal DISP has been detected, the lit-up display over the entire surface may be provided for a predetermined number of frames prior to the start of the control for the non-lit-up display over the entire surface. With this arrangement, after charges corresponding to the lit-up-display have been accumulated on all the pixels uniformly, the charges are reduced to the quantities of charge corresponding to the non-lit-up display; thus, since the quantity of charge of the display panel becomes uniform on all the pixels after the non-lit-up display over the entire surface has been provided, it becomes possible to positively eliminate remaining images.

Furthermore, the driving method for a display device of the present embodiment may be applied to a liquid crystal display having reflection-type liquid crystal display elements, with the same effects as obtained in Embodiment 1.

Here, instead of the display device having two-terminal elements as described in Embodiments 1 and 2, the driving method for a display device of the present invention may be applied to a display device having three-terminal elements such as TFTs; and in this case also, it is possible to solve the problem of remaining images. Moreover, the driving method for a display device of the present invention may be applied to a liquid crystal display in which display elements of the display device having three-terminal elements are replaced by reflection-type liquid crystal display elements, with the same effects as obtained in Embodiment 1. Moreover, in Embodiments 1 and 2, liquid crystal display elements are used as the display elements; however, not limited to this arrangement, any display elements may be used as long as their display state is determined based upon charges applied thereto.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving method for a display device, which is applied to a display device that is provided with a plurality of scanning electrodes and a plurality of data electrodes that are arranged in directions so as to intersect each other, display elements having respective pixels which are arranged in a matrix format and have their display state determined by controlling a quantity of charge, and switching elements, installed in the respective pixels, for switching a charging current to the pixels, wherein, with respect to the scanning electrodes, selection is line-sequentially made for each frame period and a selection voltage is applied thereto, and to the data electrodes is applied a data signal voltage corresponding to a display state, so that the pixels are charged, comprising the steps of:

when a power-supply signal indicating that the power supply of the display device is to be turned off is detected, switching all the pixels to a non-lit-up display state, and then stopping the application of the selection voltage to the scanning electrodes and the application of the data signal voltage to the data electrodes, wherein the display elements are maintained in the non-lit-up display state over the entire surface up to completion of a period corresponding to a predetermined number of frames after the frame in which the power-supply OFF signal has been detected.

2. The driving method for a display device as defined in claim 1, wherein a non-display period in which the selection voltage is not applied to any of the scanning electrodes is formed in one frame period, and wherein after all the pixels have been switched to the non-lit-up state after the detection of the power-supply signal, the application of the selection voltage to the scanning electrodes and the application of the data signal voltage to the data electrodes are stopped in synchronized timing with an inter non-display period signal.

3. The driving method for a display device as defined in claim 2, wherein timing in which the application of the selection voltage to the scanning electrodes and the application of the data signal voltage to the data electrodes are stopped is set to be synchronous to the scanning start signal of one frame.

4. The driving method for a display device as defined in claim 2, wherein timing in which the application of the selection voltage to the scanning electrodes and the application of the data signal voltage to the data electrodes are stopped is set to be synchronous to the start of one selection period of the scanning electrodes.

5. The driving method for a display device as defined in claim 1, wherein upon detection of the power-supply signal, a controlling process is started so as to switch the display elements to the non-lit-up state over the entire surface, and wherein after a period of time not less than the response time of the display device has elapsed since the start of the controlling process for the non-lit-up state of the pixels corresponding to the scanning electrodes that were lastly selected prior to the control, the application of the selection voltage to the scanning electrodes and the application of the data signal voltage to the data electrodes are stopped.

6. The driving method for a display device as defined in claim 1, wherein the predetermined number of frames is set to an even number.

7. The driving method for a display device as defined in claim 6, wherein during a period corresponding to a predetermined number of frames after the detection of the power-supply signal, prior to the non-lit-up display over the entire surface of the display elements, the display elements are switched to the lit-up display over the entire surface.

8. The driving method for a display device as defined in claim 1, wherein the predetermined number of frames is set to an even number.

9. A liquid crystal display, comprising:

a plurality of scanning electrodes and a plurality of data electrodes that are arranged in directions so as to intersect each other;

liquid crystal display elements of a reflection type having respective pixels which are arranged in a matrix format and have their display state determined by controlling a quantity of charge; and switching elements installed in the respective pixels, for switching a charging current to the pixels, wherein, with respect to the scanning electrodes, selection is line-sequentially made for each frame period and a selection voltage is applied thereto, and to the data electrodes is applied a data signal voltage corresponding to a display state, so that the pixels are charged, wherein, when a power-supply signal indicating that the power supply of the display device is to be turned off, after all the pixels have been switched to a non-lit-up display state, the application of the selection voltage to the scanning electrodes and the application of the data signal voltage to the data electrodes are stopped, and wherein the display elements are maintained in the non-lit-up display state over the entire surface up to completion of a period corresponding to a predetermined number of frames after the frame in which the power-supply OFF signal has been detected.

10. A display device comprising:

a plurality of pixels which is switched to a driving state when a charge is accumulated therein, and also switched to a non-driving state when the charge is drawn therefrom, and which is allowed to maintain the charge-accumulated state for not less than a predetermined time;

a driving circuit which applies a voltage cyclically to the respective pixels in order to adjust the charge in each of the pixels in accordance with display data; and a control section which has a function for detecting a power-supply signal indicating that a power supply of the driving circuit is to be turned off so that upon detection of the power-supply signal, the control section controls the driving circuit so as to switch the pixels to a non-driving state, and then turns the power supply of the driving circuit off, wherein the pixels are maintained in the non-driving display state over the entire surface up to completion of a period corresponding to a predetermined number of frames after the frame in which the power-supply OFF signal has been detected.

11. The display device as defined in claim 10, wherein the control section turns the power supply of the driving circuit off in synchronized timing with no application of voltage from the driving circuit to any of the pixels.

* * * * *

UNITED STATES PATENT AND TRADEMARK OFFICE

CERTIFICATE OF CORRECTION

PATENT NO. : 6,677,937 B1
DATED : January 13, 2004
INVENTOR(S) : Takahashi et al.

It is certified that error appears in the above-identified patent and that said Letters Patent is hereby corrected as shown below:

Title page, Item [54] and Column 1, lines 1-3,
Title, please change to read -- DRIVING METHOD FOR DISPLAY DEVICE AND A LIQUID CRYSTAL DISPLAY USING SUCH A METHOD --.

Signed and Sealed this

Thirteenth Day of July, 2004

JON W. DUDAS
*Acting Director of the United States Patent and Trademark Office*